US008296900B2

(12) United States Patent
Conrad

(10) Patent No.: US 8,296,900 B2
(45) Date of Patent: Oct. 30, 2012

(54) SEAL CONSTRUCTION FOR A SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 369 days.

(21) Appl. No.: 12/722,673

(22) Filed: Mar. 12, 2010

(65) Prior Publication Data

US 2011/0219572 A1 Sep. 15, 2011

(51) Int. Cl.

| | |
|---|---|
| ***A47L 5/14*** | (2006.01) |
| ***A47L 9/10*** | (2006.01) |
| ***B01D 45/12*** | (2006.01) |

(52) U.S. Cl. ..... 15/351; 15/353; 55/337; 55/429; 55/459.1; 55/DIG. 3

(58) Field of Classification Search ..... 15/351, 15/353; 55/337, 459.1, 429, DIG. 3
See application file for complete search history.

(56) References Cited

U.S. PATENT DOCUMENTS

| | | | | |
|---|---|---|---|---|
| 2,542,634 | A * | 2/1951 | Davis et al. | 55/426 |
| 3,356,334 | A * | 12/1967 | Scaramucci | 251/172 |
| 4,831,685 | A * | 5/1989 | Bosyj et al. | 15/344 |
| 5,078,761 | A | 1/1992 | Dyson | |
| 6,070,291 | A | 6/2000 | Bair et al. | |
| 6,463,622 | B2 * | 10/2002 | Wright et al. | 15/353 |
| 6,736,873 | B2 * | 5/2004 | Conrad et al. | 55/459.1 |
| 6,782,583 | B2 * | 8/2004 | Oh | 15/350 |
| 6,848,146 | B2 * | 2/2005 | Wright et al. | 15/353 |
| 6,902,596 | B2 * | 6/2005 | Conrad et al. | 55/459.1 |
| 7,131,165 | B2 * | 11/2006 | Wright et al. | 15/353 |
| 7,146,681 | B2 * | 12/2006 | Wright et al. | 15/353 |
| 7,604,675 | B2 * | 10/2009 | Makarov et al. | 55/345 |
| 7,645,311 | B2 * | 1/2010 | Oh et al. | 55/429 |
| 7,686,858 | B2 * | 3/2010 | Oh | 55/345 |
| 7,887,612 | B2 * | 2/2011 | Conrad | 55/343 |
| 7,922,794 | B2 * | 4/2011 | Morphey | 95/271 |
| 8,032,983 | B2 * | 10/2011 | Griffith et al. | 15/347 |

FOREIGN PATENT DOCUMENTS

WO 2009/026709 A1 3/2009

* cited by examiner

*Primary Examiner* — Jeanette E. Chapman
(74) *Attorney, Agent, or Firm* — Philip C. Mendes da Costa; Bereskin & Parr LLP/S.E.N.C.R.L., s.r.l.

(57) ABSTRACT

A surface cleaning apparatus comprises an air flow passage extending from a dirty air inlet to a clean air outlet. A suction motor positioned in the air flow passage. A cyclone is removably mounted to the surface cleaning apparatus and positioned in the air flow path. The cyclone has a cyclone air inlet and a cyclone air outlet. The cyclone is mountable to the surface cleaning apparatus in a mounting direction. An air inlet seal is positioned in a first plane and seals the cyclone air inlet to the airflow passage. An air outlet seal is positioned in a second, non-orthogonal plane and seals the cyclone air outlet to the airflow passage. The air inlet seal and the air outlet seal are concurrently sealed by movement of the cyclone in the mounting direction.

32 Claims, 8 Drawing Sheets

SEAL CONSTRUCTION FOR A SURFACE CLEANING APPARATUS

FIELD

The disclosure relates to surface cleaning apparatuses, such as vacuum cleaners. Particularly, the disclosure relates to a surface cleaning apparatus having a removably mounted cyclone and preferably an upright surface cleaning apparatus having a removably mounted cyclone.

INTRODUCTION

The following is not an admission that anything discussed below is prior art or part of the common general knowledge of persons skilled in the art.

Various constructions for surface cleaning apparatus such as vacuum cleaners are known. Currently, many surface cleaning apparatus are constructed using at least one cyclonic cleaning stage. The air is drawn into the vacuum cleaner through a dirty air inlet and conveyed to a cyclone inlet. The rotation of the air in the cyclone results in some of the particulate matter in the airflow stream being disentrained from the airflow stream. This material is then collected in a dirt collection chamber, which may be at the bottom of the cyclone or in a dirt collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

According to one aspect, a surface cleaning apparatus has a component such as a cyclone housing or bin. The component has an air inlet and an air outlet. The air inlet and the air outlet are configured such that the component is connected in air flow communication as part of the air flow path through the surface cleaning apparatus when the component is positioned on the surface cleaning apparatus by a user moving the component in a single linear direction (e.g., downwardly). Typically, cyclone housings have previously been mounted to a surface cleaning apparatus by movement in multiple directions (e.g., downwardly to place the housing on a base and then rotating the upper end of the housing to a locked position).

An advantage of this design is that the mount to secure the component, e.g., the cyclone housing, to the surface cleaning apparatus may be located at a single end. Accordingly locks may be located at the lower end of the component. Therefore, an upper frame or other structure is not required. Typically, the frame of a surface cleaning apparatus is large and provides a recess for the cyclone housing. This frame increases the weight of the surface cleaning apparatus and also creates a larger superstructure, which can decrease the ability to use the surface cleaning apparatus in confined spaces.

In accordance with this design, the sealing faces of the air inlet and the air outlet may be in different planes. For example, the air outlet seal may be generally horizontal and the air inlet may be at an acute angle to the vertical. Therefore, the air inlet may slide along its mating seal surface as the component is placed on the surface cleaning apparatus and assist in positioning the component in place. In addition, the opposed end of the portion of the surface cleaning apparatus on which the component is mounted, and/or the opposed end of the component, may have a cam member to urge the angled sealing surface of the component to its mating angled sealing surface. This caming action can enhance the air tightness of the resultant seal.

According to one aspect, a surface cleaning apparatus is provided. The surface cleaning apparatus comprises an air flow passage extending from a dirty air inlet to a clean air outlet. A suction motor positioned in the air flow passage. A cyclone is removably mounted to the surface cleaning apparatus and positioned in the air flow path. The cyclone has a cyclone air inlet and a cyclone air outlet. The cyclone is mountable to the surface cleaning apparatus in a mounting direction. An air inlet seal is positioned in a first plane and seals the cyclone air inlet to the airflow passage. An air outlet seal is positioned in a second, non-orthogonal plane and seals the cyclone air outlet to the airflow passage. The air inlet seal and the air outlet seal are concurrently sealed by movement of the cyclone in the mounting direction.

The mounting direction may be orthogonal to one of the inlet seal and the outlet seal. The other of the inlet seal and the outlet seal may be at an acute angle to the mounting direction.

At least one of the cyclone and the surface cleaning apparatus may be configured to direct the cyclone towards the other of the inlet seal and the outlet seal as the cyclone is mounted on the surface cleaning apparatus. For example, at least one of the cyclone and the surface cleaning apparatus may comprise a cam member to direct the cyclone towards the other of the inlet seal and the outlet seal as the cyclone is mounted on the surface cleaning apparatus.

One of the inlet seal and the outlet seal may at an acute angle to the mounting direction, and may have a wider seal surface than the other of the inlet seal and the outlet seal.

One of the inlet seal and the outlet seal may be at an acute angle to the mounting direction and may have a sealing flange.

Each of the inlet seal and the outlet seal may comprise a gasket and the gasket of the one of the inlet seal and the outlet seal that is at an acute angle to the mounting direction may interact with the sealing flange.

The first plane may be at an acute angle to the second plane. The first plane may be at an angle of 1° to 80°, preferably at an angle of 3° to 45° and more preferably at an angle of 5° to 25° to a line that is perpendicular to the second plane.

The cyclone air inlet and the cyclone air outlet may be at a common end of the cyclone and preferably at a mounting end.

The cyclone may be secured to the surface cleaning apparatus by movement in a linear direction.

The inlet seal may comprise a cyclone inlet sealing face provided on the surface cleaning apparatus and the outlet seal may comprise a cyclone outlet sealing face provided on the surface cleaning apparatus, and the sealing faces may be mounted at a fixed position and orientation at all times when the cyclone is secured to the surface cleaning apparatus.

According to another aspect, another surface cleaning apparatus is provided. The surface cleaning apparatus comprises an air flow passage extending from a dirty air inlet to a clean air outlet. A suction motor positioned in the air flow passage. A cyclone is removably mounted to the surface cleaning apparatus and positioned in the air flow path. The cyclone has a cyclone air inlet and a cyclone air outlet. The cyclone is mountable to the surface cleaning apparatus in a mounting direction. An air inlet seal is positioned in a first plane and seals the cyclone air inlet to the airflow passage. An air outlet seal is positioned in a second, non-orthogonal plane and seals the cyclone air outlet to the airflow passage. The inlet seal and the outlet seal are configured to be concurrently sealed by movement of the cyclone relative to the surface cleaning apparatus.

The mounting direction may be orthogonal to one of the inlet seal and the outlet seal.

One of the inlet seal and the outlet seal may be at an acute angle to the mounting direction, and at least one of the cyclone and the surface cleaning apparatus may be configured to direct the cyclone towards the one of inlet seal and the outlet seal that is at an acute angle to the mounting direction as the cyclone is mounted on the surface cleaning apparatus.

At least one of the cyclone and the surface cleaning apparatus may comprise a cam member to direct the cyclone towards the one of inlet seal and the outlet seal is that at an acute angle to the mounting direction as the cyclone is mounted on the surface cleaning apparatus.

One of the inlet seal and the outlet seal may be at an acute angle to the mounting direction and may have a wider seal surface then the other of the inlet seal and the outlet seal.

One of the inlet seal and the outlet seal may be at an acute angle to the mounting direction and may have a sealing flange.

Each of the inlet seal and the outlet seal may comprise a gasket and the gasket of the one of the inlet seal and the outlet seal that is at an acute angle to the mounting direction may interact with the sealing flange.

The inlet seal may be at an acute angle to the outlet seal. The inlet seal may be at an angle of 1° to 80°, preferably at an angle of 3° to 45° and more preferably at an angle of 5° to 25° to a line that is perpendicular to the outlet seal.

The cyclone air inlet and the cyclone air outlet may be at a common end of the cyclone.

The cyclone may be secured to the surface cleaning apparatus my movement in a linear direction.

The inlet seal may comprise a cyclone inlet sealing face provided on the surface cleaning apparatus and the outlet seal may comprise a cyclone outlet sealing face provided on the surface cleaning apparatus and the sealing faces may be mounted at a fixed position and orientation at all times when the cyclone is secured to the surface cleaning apparatus.

DRAWINGS

Reference is made in the detailed description to the accompanying drawings, in which.

Figure 1:
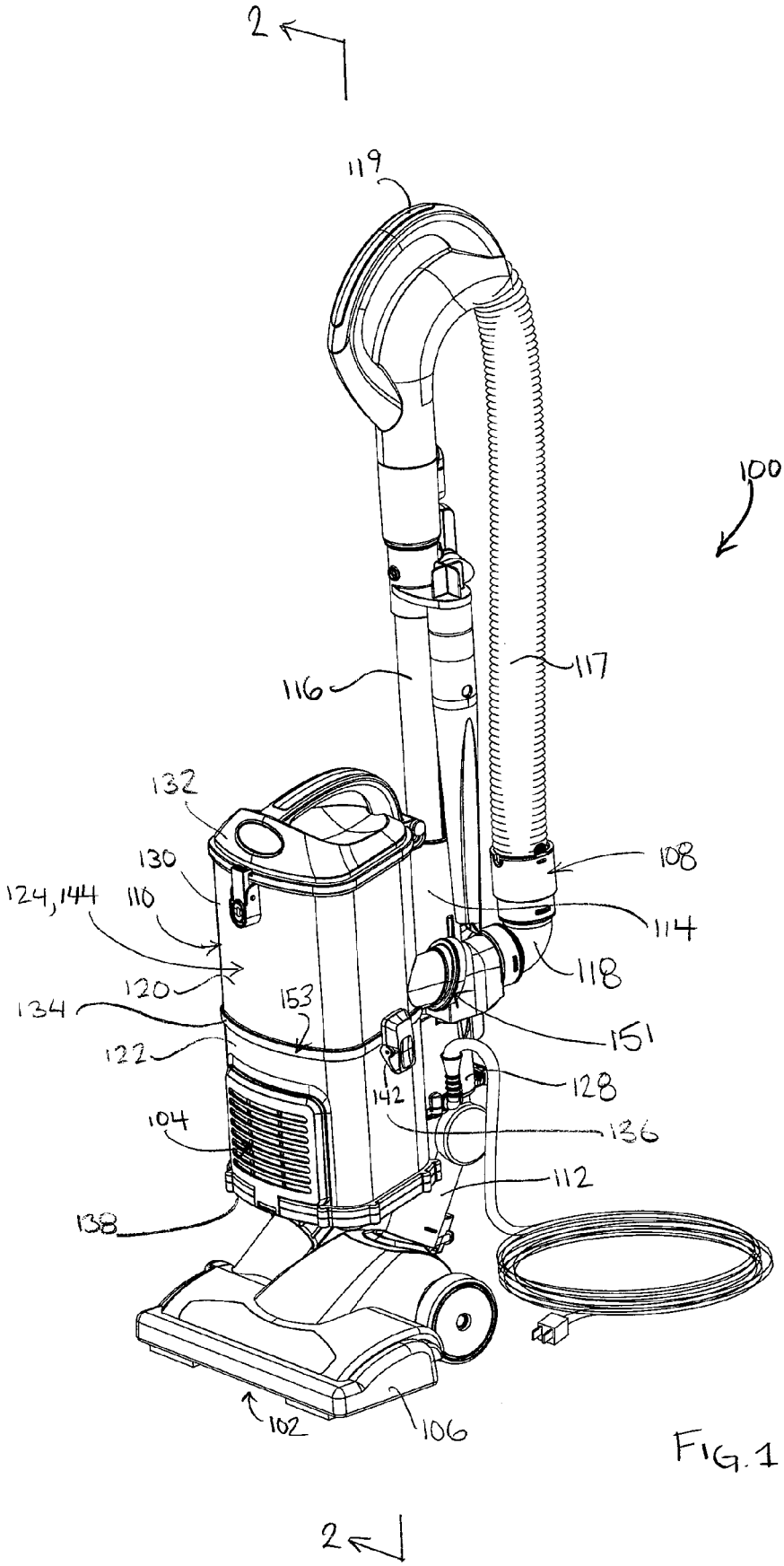
FIG. 1 is a perspective illustration of an embodiment of a surface cleaning apparatus.
Figure 2:
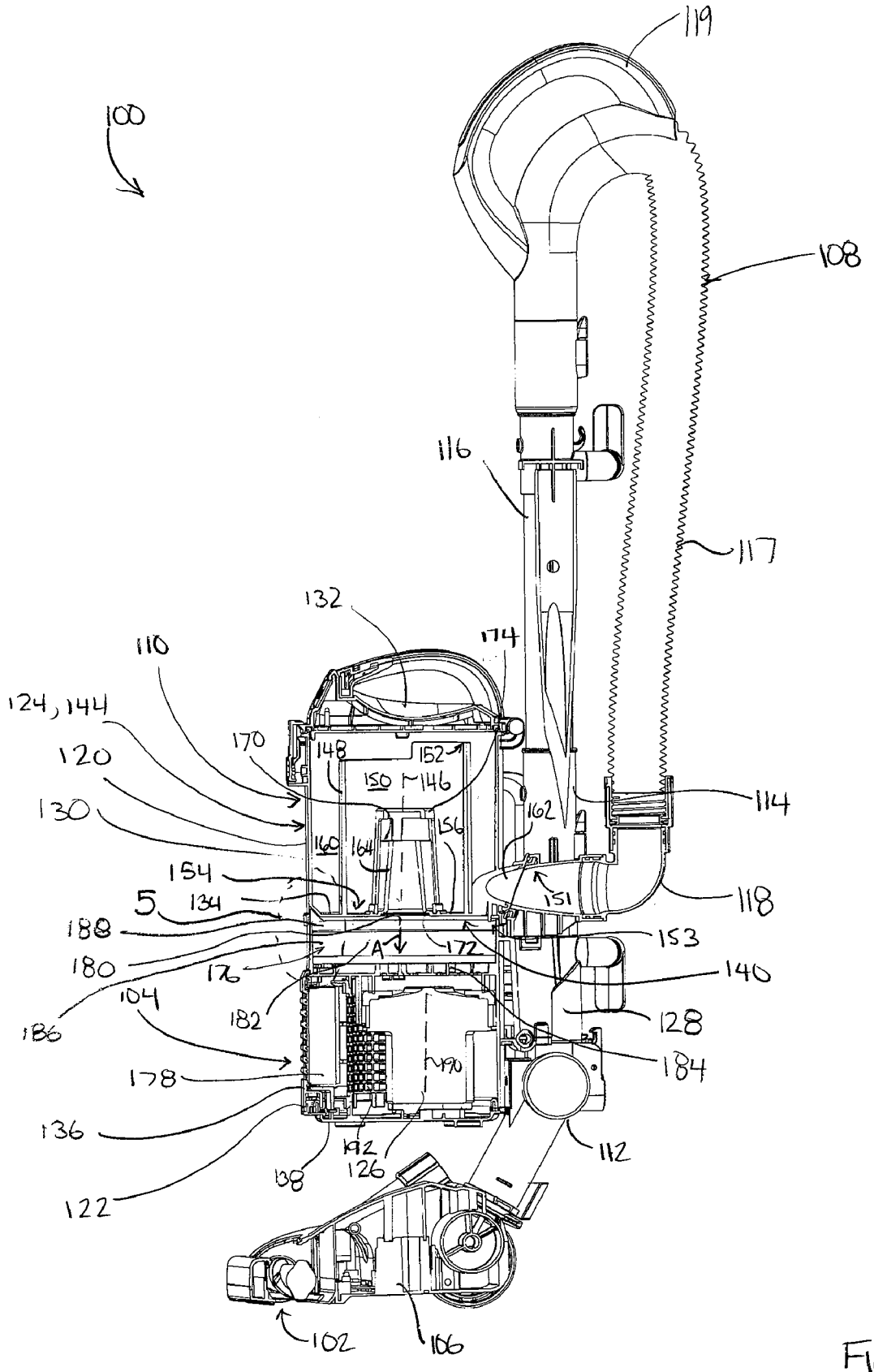
FIG. 2 is a cross section taken along line 2-2 in FIG. 1.
Figure 3A:
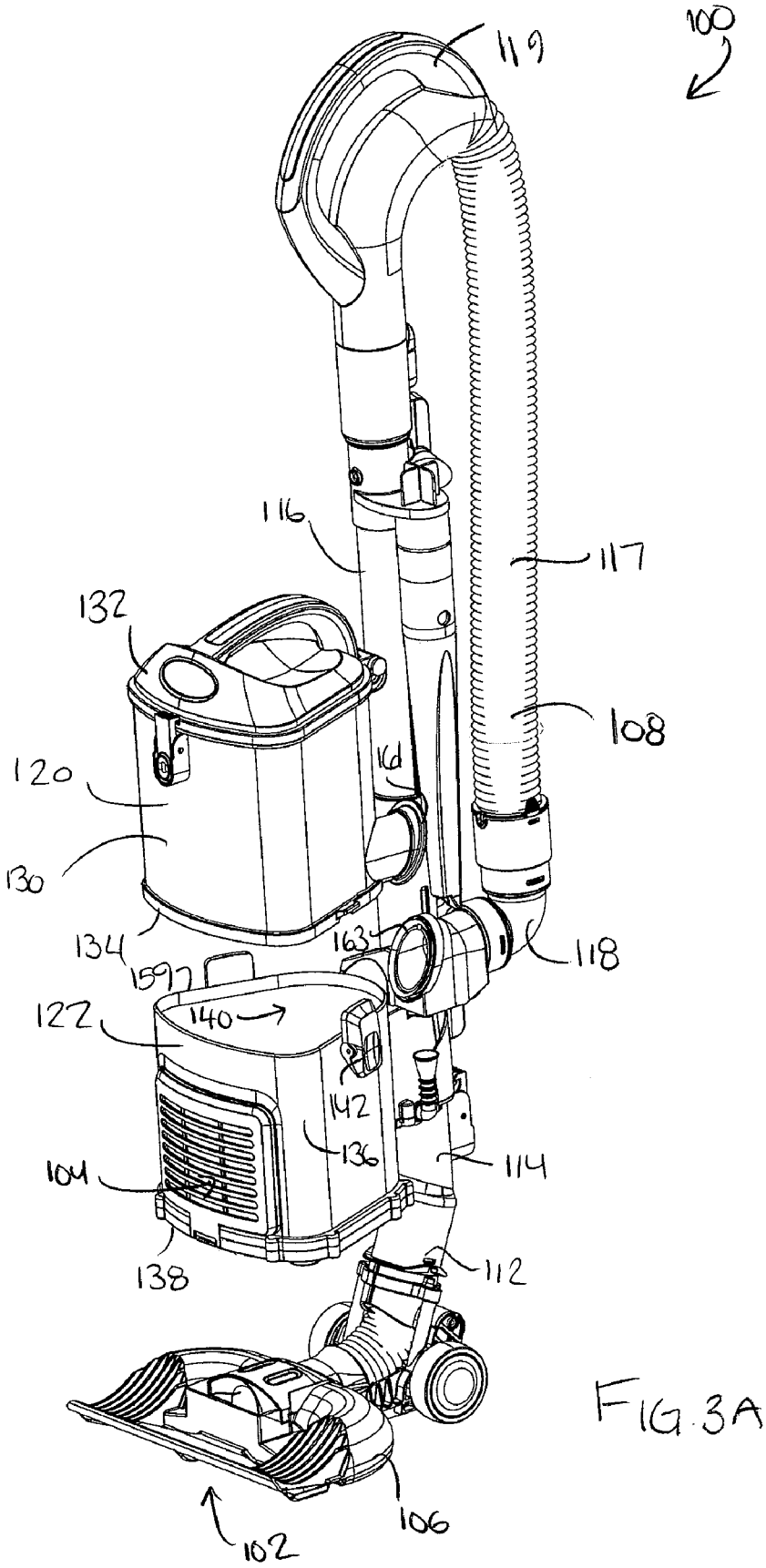
Figure 3B:
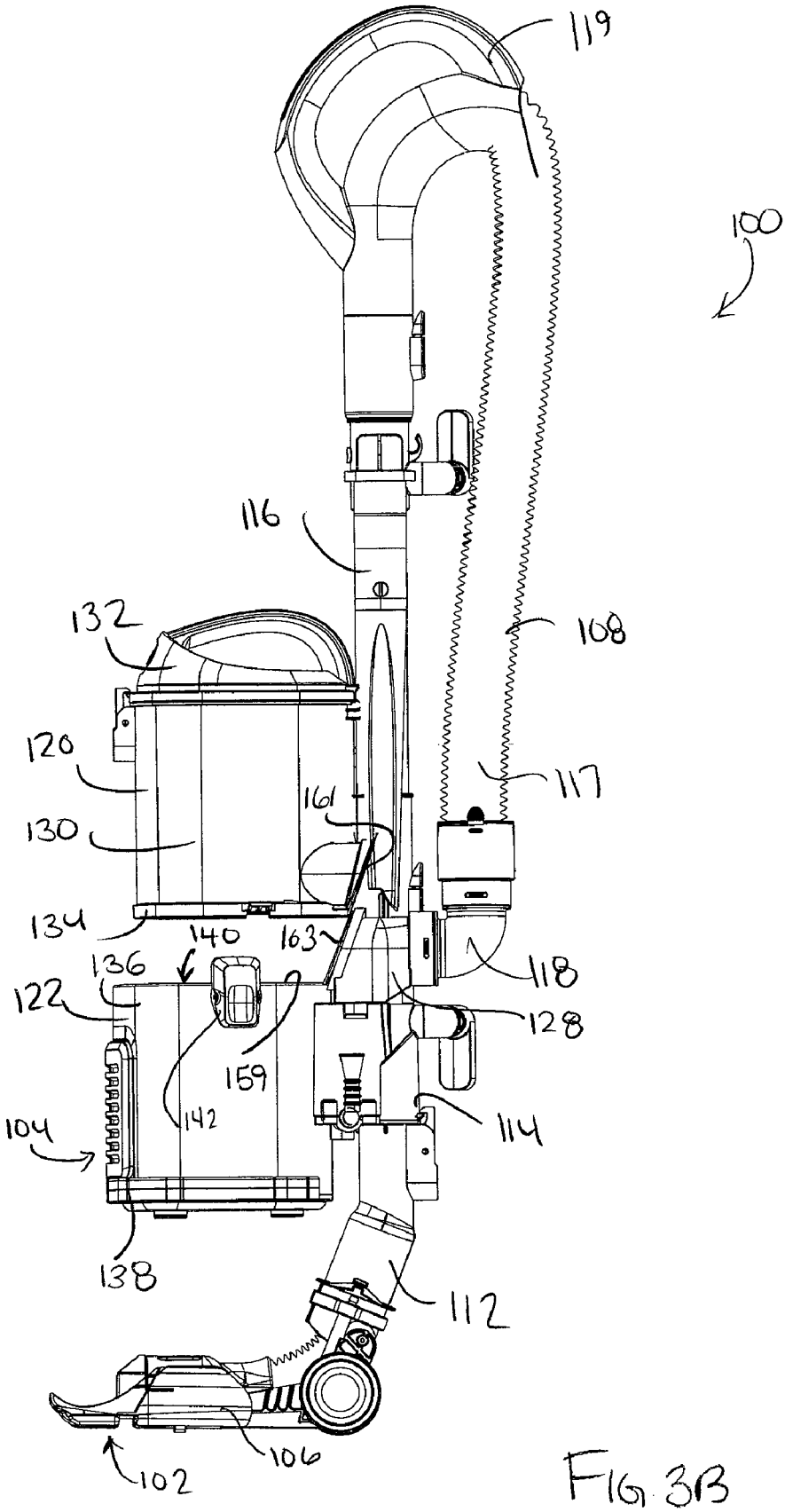
Figure 3C:
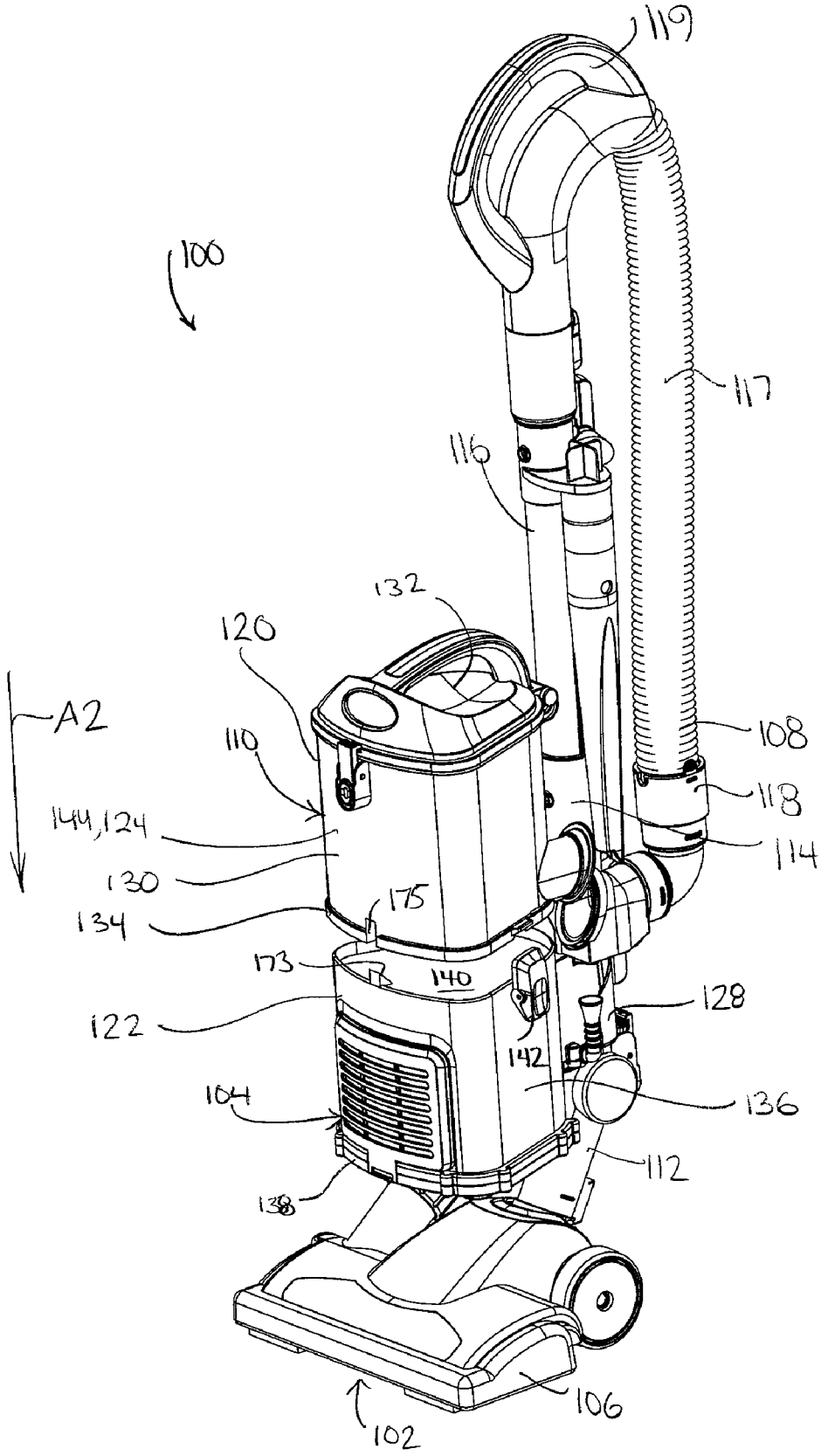
Figure 3D:
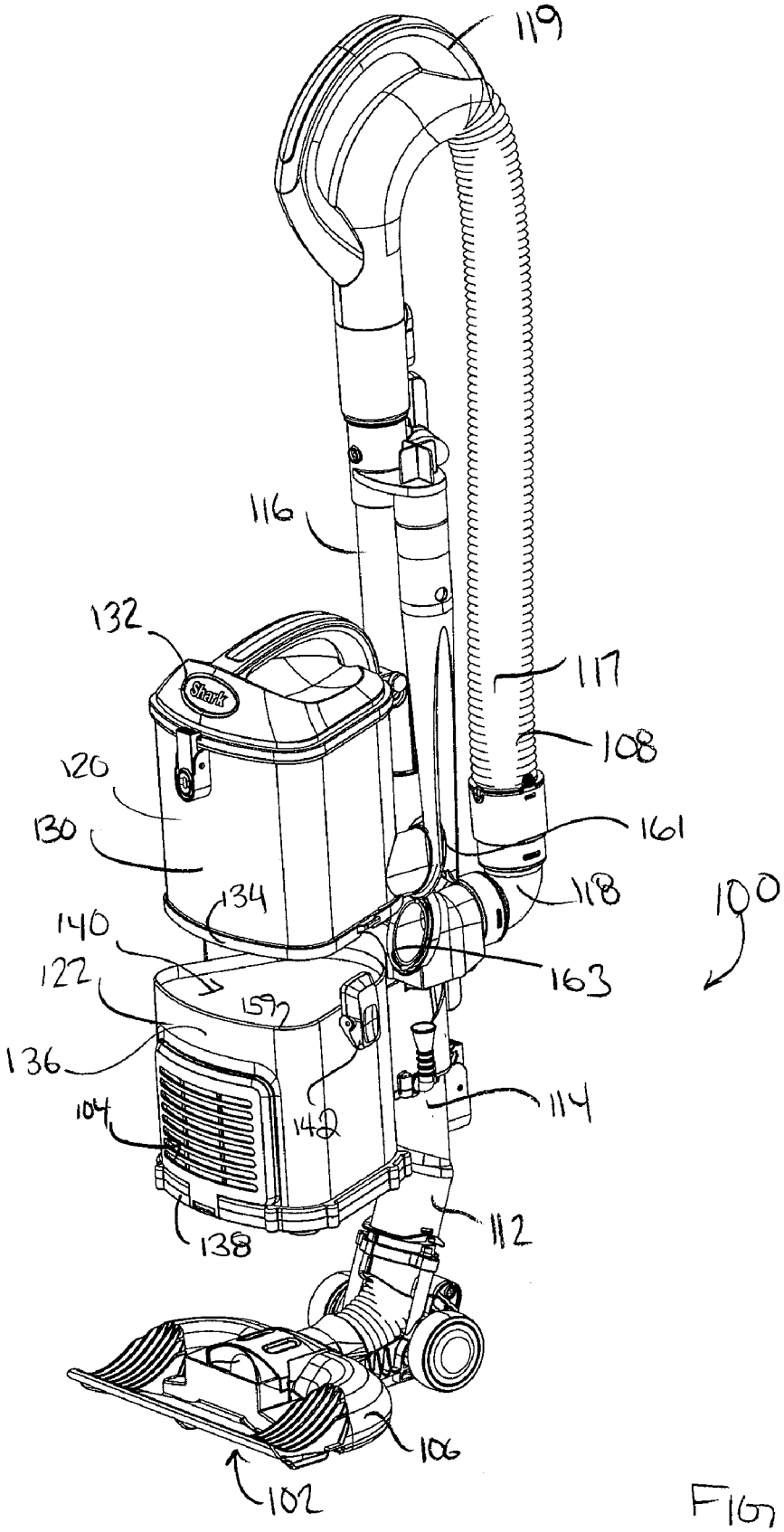
Figure 4:
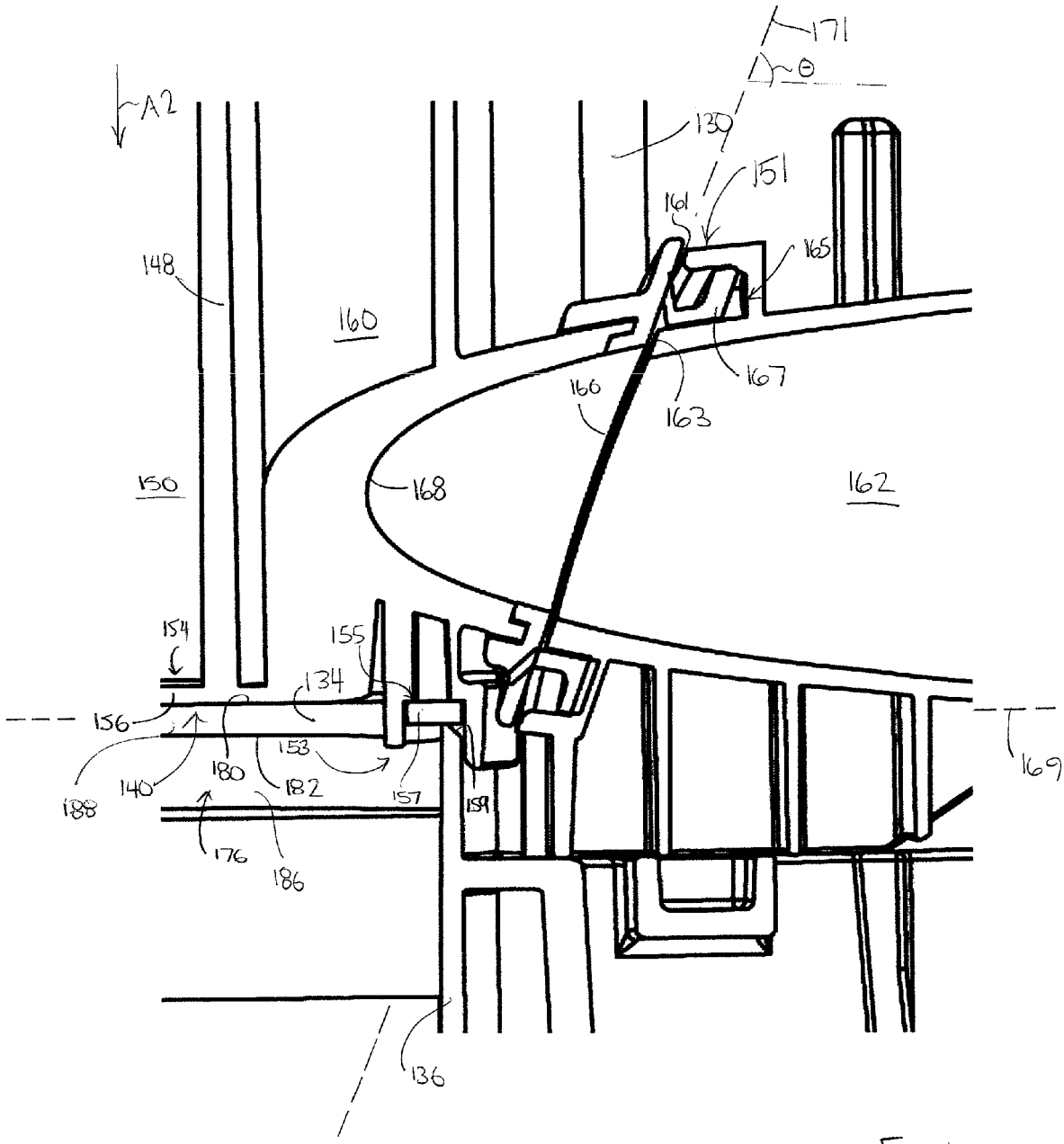
Figure 5:
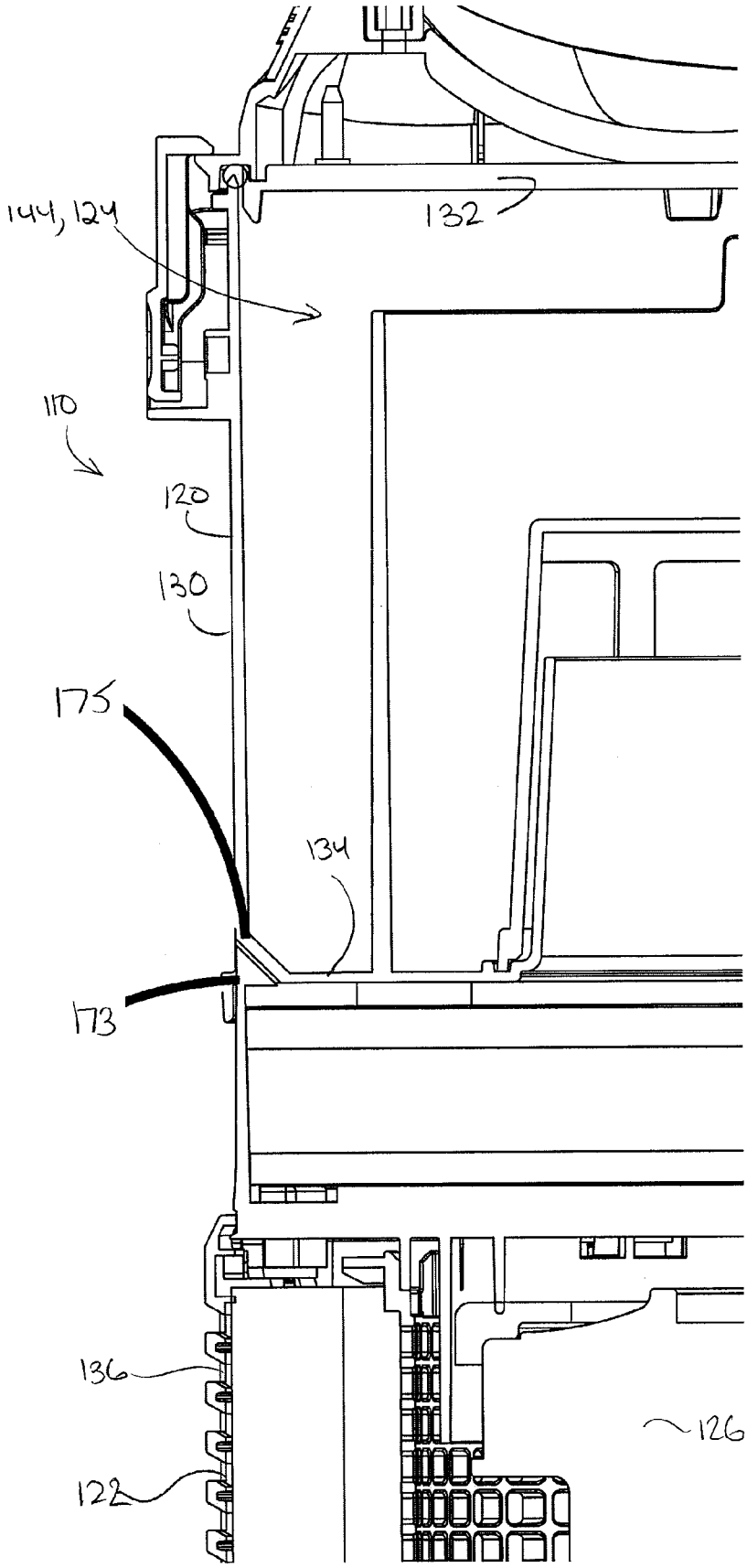

FIG. 3*a* is a perspective illustration of a surface cleaning apparatus of FIG. 1 using an alternate surface cleaning head, showing the cyclone removed from the surface cleaning apparatus;

FIG. 3*b* is a side view of the surface cleaning apparatus of FIG. 3*a*, showing the cyclone starting to be mounted to the suction motor housing of the surface cleaning apparatus;

FIG. 3*c* is a perspective illustration of the surface cleaning apparatus of FIG. 1, showing the cyclone continuing to be mounted to the suction motor housing of the surface cleaning apparatus;

FIG. 3*d* is a perspective illustration of the surface cleaning apparatus of FIG. 3*a*, showing the cyclone continuing to be mounted to the suction motor housing of the surface cleaning apparatus;

FIG. 4 is an enlarged view of the air inlet seal and air outlet seal of FIG. 2; and FIG. 5 is an enlargement of Area 5 of FIG. 2 showing the cam member.

DETAILED DESCRIPTION

Referring to FIG. 1, a first embodiment of a surface cleaning apparatus 100 is shown. In the embodiment shown, the surface cleaning apparatus 100 is an upright vacuum cleaner. In alternate embodiments, the surface cleaning apparatus may be another suitable type of surface cleaning apparatus, such as a canister type vacuum cleaner, and hand vacuum cleaner, a stick vac, a wet-dry type vacuum cleaner or a carpet extractor.

Referring still to FIG. 1, the surface cleaning apparatus 100 has a dirty air inlet 102, a clean air outlet 104, and an air flow passage extending therebetween. In the embodiment shown, the dirty air inlet 102 is provided in a lower surface of a surface cleaning head 106. From the surface cleaning head 106, the airflow passage extends through an air conduit 108, to a suction and filtration unit 110. The clean air outlet 104 is provided in the suction and filtration unit 110. In the embodiment shown, the air conduit 108 includes a pivoting joint member 112 (FIG. 3C or a hose as part of a pivoting joint member as shown in FIG. 3*a*) connected to the surface cleaning head 106, a lower upflow duct 114, an upper upflow duct 116, a hose 117, and an elbow joint 118. The elbow joint 118 is in airflow communication with the suction and filtration unit 110. In alternate embodiments, the air conduit 108 may be of another configuration. For example, only a pivoting joint member 112 and a lower upflow duct 114 may be provided.

A handle 119 is optionally mounted to the upper upflow duct 116, for manipulating the surface cleaning apparatus 100.

Referring now to FIG. 2, the suction and filtration unit 110 includes a filtration member 124, which is positioned in the airflow passage for removing particulate matter from air flowing through the airflow passage, and a suction motor 126, for drawing air through the airflow passage.

Preferably as exemplified in FIG. 2, the filtration member 124 is a cyclone 144. In alternate embodiments, the filtration member 124 may be, for example, a filter, such as a filter bag or a foam filter. In further alternate embodiments, the filtration member 124 may include a plurality of cyclones, or a plurality of cyclonic stages.

The cyclone 144 may be of any suitable configuration. In the embodiment shown, the cyclone includes a cyclone housing 120, which includes a sidewall 130, a top wall 132, and a bottom wall 134. The cyclone further includes a generally cylindrical cyclone wall 148, which extends along a longitudinal axis 146, and which defines a cyclone chamber 150, and which is provided within the cyclone housing 120. The upper end 152 of the cyclone wall 148 is open, and the lower end 154 of the cyclone wall includes lower wall 156. The cyclone wall 148 is positioned in the cyclone housing 120 such that it is spaced from the sidewall 130, and top wall 132 of the cyclone housing 120. The lower wall 156 is integral with the bottom wall 134. An annular space between the cyclone wall 148 and the sidewall 130 forms a dirt collection chamber 160.

The cyclone 144 further includes a cyclone air inlet 162, and a cyclone air outlet 164. The cyclone air inlet 162 extends generally horizontally from a first end 166 that is in communication with the hose 117, through the sidewall 130 of the cyclone housing 120, to a second end 168 that is in communication with the cyclone chamber 150 (shown in FIG. 4). The cyclone air outlet 164 extends generally vertically along the axis 146, from a first end 170 that is positioned within the cyclone chamber 150, through the lower wall 156, and through the bottom wall 134, to a second end 172. In the embodiment shown, the second end 172 comprises an aperture in the bottom wall 134. The aperture is in communication with the interior of a suction motor housing 122, described below. A screen 172 is preferably mounted over the first end 170 of the cyclone air outlet.

The cyclone air inlet 162 and the cyclone air outlet 164 are preferably at a common end of the cyclone 144. For example, in the embodiment shown, both the cyclone air inlet and the cyclone air outlet are adjacent the bottom wall 134 of the cyclone housing 120.

In use, air flows from the hose 117 into the cyclone chamber 150 through the cyclone air inlet 162. In the cyclone chamber 150, the air flows within the cyclone wall 148 in a cyclonic pattern, and particulate matter is separated from the air. The particulate matter exits the cyclone chamber 150 through a dirt outlet at the first end 152 (which may be a gap between the end face of cyclone wall 148 that faces top wall 132), and settles in the dirt collection chamber 160. The air exits the cyclone chamber 150 through the cyclone air outlet 164, and enters the suction motor housing 122.

The dirt collection chamber 160 may be emptied in any suitable manner. In the embodiment shown, the bottom wall 134 is pivotally mounted to the sidewall 130, and serves as an openable door. The dirt collection chamber 160 may be emptied by removing the filtration member housing 120 from the suction motor housing 124, as described hereinabove, and opening or pivoting the bottom wall 134 away from the sidewall 130.

Referring still to FIG. 2, the suction motor 126 is housed in a suction motor housing 122, which preferably also houses a pre-motor filter 176 upstream of the suction motor 126 and downstream of the cyclone 144, and preferably also a post-motor filter 178 downstream of the suction motor 126 and upstream of the clean air outlet 104. The suction motor housing 122 includes a sidewall 136 and a bottom wall 138, and an open top 140. The second end 172 of the cyclone air outlet 164 faces the open top 140. The bottom wall 134 of the cyclone housing 120 is mounted to the sidewall 136 of the suction motor housing 122, so that the bottom wall 134 of the cyclone housing 120 seals the open top 140 of the suction motor housing 122.

In the embodiment shown, the suction and filtration unit 110 is supported by the suction motor housing 122, which is mounted to the lower upflow duct 114. Particularly, a mount 128 is provided which mounts the suction motor housing 122 to the lower upflow duct 114. The mount 128 may be of any suitable configuration. In the embodiment shown, the mount 128 is integrally formed with the suction motor housing 122, and is mountable to the lower upflow duct 114. The mount 128 may be mountable to the lower upflow duct 114 in any suitable manner, and is preferably removably mountable to the lower upflow duct 114.

The pre-motor filter 176 may extend across the open top 140 of the suction motor housing 122, and has an upstream side 180 that faces the cyclone air outlet 164, and an opposed downstream side 182 that faces the bottom wall 138 of the suction motor housing 122. The pre-motor filter 176 is supported within the suction motor housing 122 by an apertured support wall 184, which extends across the suction motor housing 122. The pre-motor filter 176 is sized to be generally snugly received within the suction motor housing 122, such that air entering the suction motor housing 122 from the cyclone air outlet 164 passes through the pre-motor filter 176, in a direction indicated by arrow A. The pre-motor filter 176 may be any suitable type of filter. Preferably, the pre-motor filter includes a foam layer 186 and a felt layer 188.

When the cyclone housing 120 is lifted off of the suction motor housing 122, the pre-motor filter 176 is exposed, and may be removed, replaced, or cleaned.

Referring still to FIG. 2, the suction motor 126 is housed within the suction motor housing 122 beneath the apertured support wall 184. The suction motor 126 may be any suitable type of suction motor. In the embodiment shown, the suction motor 126 extends along a longitudinal axis 190 that is generally vertically extending.

The post motor filter 178 is housed within the suction motor housing 122 adjacent the suction motor 126, and between the suction motor 126 and the clean air outlet 104. Preferably, a second apertured wall 192 is provided between the suction motor 126 and the post-motor filter 178. The post-motor filter 178 may be any suitable type of filter, such as a HEPA filter.

It is possible that in some instances, the airflow passage may become fully or partially clogged. For example, a large object, such as a ball of hair, may become lodged anywhere in the airflow passage, such as in the surface cleaning head 106. For further example, the pre-motor filter 176 may become clogged with particulate matter. If this occurs, the suction motor 126 may burn out. A bleed-valve (not shown) may be provided in the suction motor housing 122. If a clog occurs in the airflow passage, the pressure in the suction motor housing 122 will decrease. The bleed valve is preferably configured to open when the pressure decreases, and allow air to flow through the suction motor housing 122 to the clean air outlet 104 so that the suction motor 126 does not burn out.

It will be appreciated that the various elements discussed herein are for reference for the discussion of the specific exemplified embodiments and that the elements may be of various constructions known in the art. It will also be appreciated that some elements that are discussed are optional and need not be in any particular embodiment.

Referring now to FIGS. 3*a*-3*d*, the cyclone 144 is removably mounted to the surface cleaning apparatus 100. Specifically, the cyclone 144 is mountable to the suction motor housing in a mounting direction, indicated by arrow A2 in FIG. 3. The cyclone 144 is mountable to the surface cleaning apparatus 100 by moving the cyclone 144 in the mounting direction. Preferably, the mounting direction is generally vertically extending, and is a generally linear direction.

Referring to FIGS. 2 and 3*a*-3*d*, when the cyclone 144 is mounted to the surface cleaning apparatus, an air inlet seal 151 seals the cyclone air inlet 162 to the airflow passage. Specifically, the cyclone air inlet 162 is sealed to the elbow joint 118 by the air inlet seal. Further, an air outlet seal 153 seals the cyclone air outlet 164 to the airflow passage. Specifically, the air outlet seal 153 seals the bottom wall 138 of the 134 of the cyclone housing 120 to the sidewall 136 of the suction motor housing 122, so that the second end 172 of the cyclone air outlet 164 is sealed in fluid communication with the open top 140 of the suction motor housing 122. Preferably, the inlet seal 151 and the outlet seal 153 are configured to be concurrently sealed by movement of the cyclone 144 relative to the surface cleaning apparatus 100 in a mounting direction, which is preferably a single linear direction. Suitable gaskets may be provided at any location.

Referring to FIGS. 3 and 4, the air outlet seal 153 comprises a downwardly open recess 155 defined in the bottom wall 134 of the cyclone housing 144 and extending about the perimeter of the bottom wall 134, a gasket 157 that is seated in the recess 155, and a cyclone outlet sealing face 159 at the sidewall 136 of the suction motor housing 122 at the open top 140 of the suction motor housing 122. When the cyclone is mounted to the surface cleaning apparatus, the sidewall 136 of the suction motor housing abuts and compresses the gasket, to seal the cyclone air outlet 164 in fluid communication with the open top 140 of the suction motor housing 122. In order to compress the gasket 157, one or more latch members 142 is preferably provided. In the embodiment shown, a latch member 142 is provided on opposed lateral sides. When the cyclone 144 is mounted to the surface cleaning apparatus 100, the latch member 142 forces the cyclone housing 120 in the mounting direction, so the gasket 157 is compressed between the bottom wall 134 and the sidewall 136. Further, the latch member 142 removably locks the cyclone housing 120 to the suction motor housing 122. The latch member 142 may be of any suitable configuration that when latched, forces the cyclone housing 120 in the mounting direction and locks the cyclone casing 120 to the suction motor housing 122. In the embodiment shown, the latch member 142 is a luggage-type latch. Accordingly, as exemplified, the latching member 142 is a non-rotational locking member and preferably applies a force to the cyclone housing only in the mounting direction.

Referring still to FIGS. 3 and 4, the air inlet seal 151 includes a sealing flange 161 at the first end 166 of the cyclone air inlet 162. The sealing flange 161 extends at an acute angle θ to the cyclone air inlet 162 (i.e. extends at an acute angle to the vertical, see FIG. 4). The air inlet seal 151 further includes a cyclone inlet sealing face 163 on the elbow joint 118 of the surface cleaning apparatus 100, which is positioned at the same angle θ as the sealing flange 161. The sealing face 163 defines a recess 165 that faces the sealing flange 161, and a gasket 167 is seated in the recess 165. When the cyclone 144 is mounted to the surface cleaning apparatus 100, the sealing flange 161 interacts with the gasket 167 to abut and compress the gasket 167, to seal the cyclone air inlet 162 in fluid communication with the elbow joint 118.

Referring still to FIG. 4, the air inlet seal 151 is positioned in a first plane 171. Further, the air outlet seal 153 is positioned in a second plane 169, which is non-orthogonal to the first plane 171, and is preferably generally horizontal. Specifically, the air outlet seal 153 is positioned in a generally horizontal plane 169, and the air inlet seal is positioned in a plane 171 that extends at an angle between horizontal and vertical and is preferably at an acute angle to the vertical.

Preferably, the mounting direction is orthogonal to the air outlet seal 153, and at an acute angle to the air inlet seal 151. Accordingly, by moving the cyclone 144 in the mounting direction, both the air inlet seal 151 and the air outlet seal 153 are concurrently sealed. Specifically, when the cyclone housing 120 is moved towards the suction motor housing 122 in the mounting direction, and the latch members 142 are actuated to further force the cyclone housing 120 in the mounting direction, so that the gasket 157 is compressed between the bottom wall 134 and the sidewall 136, the gasket 167 is also compressed between the sealing flange 161 and the sealing face 162. Accordingly, when the cyclone 144 is removed from the surface cleaning apparatus 100, and is then moved in the mounting direction to mount the cyclone 144 to the surface cleaning apparatus 100, the air inlet seal 151 and air outlet seal 153 are concurrently sealed.

The first plane 169 and the second plane 171 may be at any suitable angle. Preferably, the first plane 169 is at an acute angle to the vertical and may be at an angle of 1° to 80° to the vertical, preferably at an angle of 3° to 45° to the vertical and most preferably at an angle of 5° to 25° to the vertical.

Referring to FIGS. 2 and 3, in some embodiments, the surface cleaning apparatus may be configured to further direct the cyclone towards inlet seal as the cyclone is mounted on the surface cleaning apparatus. For example, as exemplified in FIG. 5, a cam member 173 is positioned on the suction motor housing 122 (e.g., on an opposed side of the suction motor housing to the elbow) to direct the cyclone 144 towards the inlet seal 151 as the cyclone 144 is mounted on the surface cleaning apparatus 100. Particularly, the cam member 173 interacts with an optional angled surface 175 on the cyclone housing 120, to direct the cyclone air inlet 162 towards the elbow joint 118. It will be appreciated that the cyclone housing and/or the suction motor housing may be provided with a cam member and, preferably, each is provided with interacting cam members.

Referring to FIGS. 1 and 4, the air inlet seal preferably has a wider seal surface that the outlet seal. For example, the cyclone air inlet 162 may be provided with a flange 161. One advantage of the flange is that the gasket has a larger surface to contact then the thickness of a wall of the cyclone air inlet. Further, a gasket with a larger contact surface may be used.

Preferably, the sealing faces are mounted at a fixed position and orientation at all times when the cyclone is secured to the surface cleaning apparatus.

In alternate embodiments, the air inlet seal 151 may be orthogonal to the mounting direction, and the air outlet seal 153 may be at an acute angle to the mounting direction. Further, the gaskets may be located on the opposed faces to those exemplified herein.

Various apparatuses or methods are described above to provide an example of each claimed invention. No example described above limits any claimed invention and any claimed invention may cover processes or apparatuses that are not described above. The claimed inventions are not limited to apparatuses or processes having all of the features of any one apparatus or process described above or to features common to multiple or all of the apparatuses described above.

The invention claimed is:

1. A surface cleaning apparatus comprising:

(a) an air flow passage extending from a dirty air inlet to a clean air outlet;

(b) a suction motor positioned in the air flow path; and, (c) a cyclone having a cyclone air inlet comprising a passage provided on a wall of the cyclone and a cyclone air outlet, the cyclone being removable from the surface cleaning apparatus with the cyclone inlet the cyclone being positioned in the air flow path when mounted to the surface cleaning apparatus, the cyclone is mountable to the surface cleaning apparatus in a mounting direction;

(d) an air inlet seal positioned in a first plane and sealing the cyclone air inlet to the airflow passage;

(e) an air outlet seal positioned in a second, non-orthogonal plane and sealing the cyclone air outlet to the airflow passage; and, (f) the air inlet seal and the air outlet seal are concurrently sealed by movement of the cyclone in the mounting direction.

2. The surface cleaning apparatus of claim 1 wherein the mounting direction is orthogonal to one of the inlet seal and the outlet seal.

3. The surface cleaning apparatus of claim 2 wherein the other of the inlet seal and the outlet seal is at an acute angle to the mounting direction, and at least one of the cyclone and the surface cleaning apparatus is configured to direct the cyclone towards the other of the inlet seal and the outlet seal as the cyclone is mounted on the surface cleaning apparatus.

4. The surface cleaning apparatus of claim 3 wherein at least one of the cyclone and the surface cleaning apparatus comprises a cam member to direct the cyclone towards the other of the inlet seal and the outlet seal as the cyclone is mounted on the surface cleaning apparatus.

5. The surface cleaning apparatus of claim 1 wherein one of the inlet seal and the outlet seal is at an acute angle to the mounting direction and has a wider seal surface than the other of the inlet seal and the outlet seal.

6. The surface cleaning apparatus of claim 1 wherein one of the inlet seal and the outlet seal is at an acute angle to the mounting direction and has a sealing flange.

7. The surface cleaning apparatus of claim 6 wherein each of the inlet seal and the outlet seal comprises a gasket and the gasket of the one of the inlet seal and the outlet seal that is at an acute angle to the mounting direction interacts with the sealing flange.

8. The surface cleaning apparatus of claim 1 wherein the first plane is at an acute angle to a line that is perpendicular to the second plane.

9. The surface cleaning apparatus of claim 8 wherein the first plane is at an angle of 1° to 80° to the line that is perpendicular to the second plane.

10. The surface cleaning apparatus of claim 6 wherein the first plane is at an angle of 3° to 45° to the line that is perpendicular to the second plane.

11. The surface cleaning apparatus of claim 8 wherein the cyclone air inlet and the cyclone air outlet are at a common end of the cyclone.

12. The surface cleaning apparatus of claim 1 wherein the cyclone is secured to the surface cleaning apparatus by movement in a linear direction.

13. The surface cleaning apparatus of claim 1 wherein the inlet seal comprises a cyclone inlet sealing face provided on the surface cleaning apparatus and the outlet seal comprises a cyclone outlet sealing face provided on the surface cleaning apparatus and the sealing faces are mounted at a fixed position and orientation at all times when the cyclone is secured to the surface cleaning apparatus.

14. A surface cleaning apparatus comprising:

(a) an air flow passage extending from a dirty air inlet to a clean air outlet;

(b) a suction motor positioned in the air flow path;

(c) a cyclone having a cyclone air inlet comprising a passage provided on a wall of the cyclone and a cyclone air outlet, the cyclone being removable from the surface cleaning apparatus with the cyclone inlet, the cyclone being positioned in the air flow path when mounted to the surface cleaning apparatus, the cyclone is mountable to the surface cleaning apparatus in a mounting direction;

(d) an air inlet seal positioned in a first plane and sealing the cyclone air inlet to the airflow passage;

(e) an air outlet seal positioned in a second, non-orthogonal plane and sealing the cyclone air outlet to the airflow passage; and, (f) the inlet seal and the outlet seal are configured to be concurrently sealed by movement of the cyclone relative to the surface cleaning apparatus.

15. The surface cleaning apparatus of claim 14 wherein the mounting direction is orthogonal to one of the inlet seal and the outlet seal.

16. The surface cleaning apparatus of claim 14 wherein one of the inlet seal and the outlet seal is at an acute angle to the mounting direction, and at least one of the cyclone and the surface cleaning apparatus is configured to direct the cyclone towards the one of inlet seal and the outlet seal that is at an acute angle to the mounting direction as the cyclone is mounted on the surface cleaning apparatus.

17. The surface cleaning apparatus of claim 16 wherein at least one of the cyclone and the surface cleaning apparatus comprises a cam member to direct the cyclone towards the one of inlet seal and the outlet seal is at an acute angle to the mounting direction as the cyclone is mounted on the surface cleaning apparatus.

18. The surface cleaning apparatus of claim 14 wherein one of the inlet seal and the outlet seal is at an acute angle to the mounting direction and has a wider seal surface then the other of the inlet seal and the outlet seal.

19. The surface cleaning apparatus of claim 14 wherein one of the inlet seal and the outlet seal is at an acute angle to the mounting direction and has a sealing flange.

20. The surface cleaning apparatus of claim 19 wherein each of the inlet seal and the outlet seal comprises a gasket and the gasket of the one of the inlet seal and the outlet seal that is at an acute angle to the mounting direction interacts with the sealing flange.

21. The surface cleaning apparatus of claim 14 wherein the inlet seal is at an acute angle to a line that is perpendicular to the outlet seal.

22. The surface cleaning apparatus of claim 14 wherein the inlet seal is at an angle of 1° to 80° to a line that is perpendicular to the outlet seal.

23. The surface cleaning apparatus of claim 14 wherein the inlet seal is at an angle of 3° to 45° to a line that is perpendicular to the outlet seal.

24. The surface cleaning apparatus of claim 14 wherein the cyclone air inlet and the cyclone air outlet are at a common end of the cyclone.

25. The surface cleaning apparatus of claim 14 wherein the cyclone is secured to the surface cleaning apparatus my movement in a linear direction.

26. The surface cleaning apparatus of claim 14 wherein the inlet seal comprises a cyclone inlet sealing face provided on the surface cleaning apparatus and the outlet seal comprises a cyclone outlet sealing face provided on the surface cleaning apparatus and the sealing faces are mounted at a fixed position and orientation at all times when the cyclone is secured to the surface cleaning apparatus.

27. A surface cleaning apparatus comprising:

(a) an air flow passage extending from a dirty air inlet to a clean air outlet;

(b) a suction motor positioned in the air flow path; and, (c) a cyclone removably mounted to the surface cleaning apparatus and positioned in the air flow path, the cyclone having a cyclone air inlet and a cyclone air outlet, the cyclone is mountable to the surface cleaning apparatus in a mounting direction;

(d) an air inlet seal positioned in a first plane and sealing the cyclone air inlet to the airflow passage;

(e) an air outlet seal positioned in a second, non-orthogonal plane and sealing the cyclone air outlet to the airflow passage; and, (f) the air inlet seal and the air outlet seal are concurrently sealed by movement of the cyclone in the mounting direction wherein at least one of the cyclone and the surface cleaning apparatus comprises a cam member to direct the cyclone towards the other of the inlet seal and the outlet seal as the cyclone is mounted on the surface cleaning apparatus.

28. A surface cleaning apparatus comprising:

(a) an air flow passage extending from a dirty air inlet to a clean air outlet;

(b) a suction motor positioned in the air flow path; and, (c) a cyclone removably mounted to the surface cleaning apparatus and positioned in the air flow path, the cyclone having a cyclone air inlet and a cyclone air outlet, the cyclone is mountable to the surface cleaning apparatus in a mounting direction;

(d) an air inlet seal positioned in a first plane and sealing the cyclone air inlet to the airflow passage;

(e) an air outlet seal positioned in a second, non-orthogonal plane and sealing the cyclone air outlet to the airflow passage; and, (f) the air inlet seal and the air outlet seal are concurrently sealed by movement of the cyclone in the mounting direction wherein one of the inlet seal and the outlet seal is at an acute angle to the mounting direction and has a wider seal surface than the other of the inlet seal and the outlet seal.

29. A surface cleaning apparatus comprising:

(a) an air flow passage extending from a dirty air inlet to a clean air outlet;

(b) a suction motor positioned in the air flow path; and, (c) a cyclone removably mounted to the surface cleaning apparatus and positioned in the air flow path, the cyclone having a cyclone air inlet and a cyclone air outlet, the cyclone is mountable to the surface cleaning apparatus in a mounting direction;

(d) an air inlet seal positioned in a first plane and sealing the cyclone air inlet to the airflow passage;

(e) an air outlet seal positioned in a second, non-orthogonal plane and sealing the cyclone air outlet to the airflow passage; and, (f) the air inlet seal and the air outlet seal are concurrently sealed by movement of the cyclone in the mounting direction wherein the cyclone air inlet and the cyclone air outlet are at a common end of the cyclone.

30. A surface cleaning apparatus comprising:

(a) an air flow passage extending from a dirty air inlet to a clean air outlet;

(b) a suction motor positioned in the air flow path;

(c) a cyclone removably mounted to the surface cleaning apparatus and positioned in the air flow path, the cyclone having a cyclone air inlet and a cyclone air outlet, the cyclone is mountable to the surface cleaning apparatus in a mounting direction;

(d) an air inlet seal positioned in a first plane and sealing the cyclone air inlet to the airflow passage;

(e) an air outlet seal positioned in a second, non-orthogonal plane and sealing the cyclone air outlet to the airflow passage; and, (f) the inlet seal and the outlet seal are configured to be concurrently sealed by movement of the cyclone relative to the surface cleaning apparatus wherein at least one of the cyclone and the surface cleaning apparatus comprises a cam member to direct the cyclone towards the one of inlet seal and the outlet seal is at an acute angle to the mounting direction as the cyclone is mounted on the surface cleaning apparatus.

31. A surface cleaning apparatus comprising:

(a) an air flow passage extending from a dirty air inlet to a clean air outlet;

(b) a suction motor positioned in the air flow path;

(c) a cyclone removably mounted to the surface cleaning apparatus and positioned in the air flow path, the cyclone having a cyclone air inlet and a cyclone air outlet, the cyclone is mountable to the surface cleaning apparatus in a mounting direction;

(d) an air inlet seal positioned in a first plane and sealing the cyclone air inlet to the airflow passage;

(e) an air outlet seal positioned in a second, non-orthogonal plane and sealing the cyclone air outlet to the airflow passage; and, (f) the inlet seal and the outlet seal are configured to be concurrently sealed by movement of the cyclone relative to the surface cleaning apparatus wherein one of the inlet seal and the outlet seal is at an acute angle to the mounting direction and has a wider seal surface then the other of the inlet seal and the outlet seal.

32. A surface cleaning apparatus comprising:

(a) an air flow passage extending from a dirty air inlet to a clean air outlet;

(b) a suction motor positioned in the air flow path;

(c) a cyclone removably mounted to the surface cleaning apparatus and positioned in the air flow path, the cyclone having a cyclone air inlet and a cyclone air outlet, the cyclone is mountable to the surface cleaning apparatus in a mounting direction;

(d) an air inlet seal positioned in a first plane and sealing the cyclone air inlet to the airflow passage;

(e) an air outlet seal positioned in a second, non-orthogonal plane and sealing the cyclone air outlet to the airflow passage; and, (f) the inlet seal and the outlet seal are configured to be concurrently sealed by movement of the cyclone relative to the surface cleaning apparatus wherein the cyclone air inlet and the cyclone air outlet are at a common end of the cyclone.

* * * * *

UNITED STATES PATENT AND TRADEMARK OFFICE

CERTIFICATE OF CORRECTION

PATENT NO. : 8,296,900 B2
APPLICATION NO. : 12/722673
DATED : October 30, 2012
INVENTOR(S) : Wayne Ernest Conrad It is certified that error appears in the above-identified patent and that said Letters Patent is hereby corrected as shown below:

In the Claims

1. Column 8, line 40, "… the cyclone being removable from the surface cleaning apparatus with the cyclone inlet the cyclone being positioned in the air flow path…" should read --… the cyclone being removable from the surface cleaning apparatus with the cyclone inlet, the cyclone being positioned in the air flow path…--.

Signed and Sealed this
Thirtieth Day of September, 2014

Michelle K. Lee

Michelle K. Lee
*Deputy Director of the United States Patent and Trademark Office*